US008475603B2

(12) United States Patent
Kaiser

(10) Patent No.: US 8,475,603 B2
(45) Date of Patent: Jul. 2, 2013

(54) SELF-SANITIZING AUTOMATED CONDENSATE DRAIN CLEANER AND RELATED METHOD OF USE

(76) Inventor: Stewart Kaiser, Boca Raton, FL (US)

( * ) Notice: Subject to any disclaimer, the term of this patent is extended or adjusted under 35 U.S.C. 154(b) by 418 days.

(21) Appl. No.: 12/816,430

(22) Filed: Jun. 16, 2010

(65) Prior Publication Data

US 2011/0308546 A1 Dec. 22, 2011

(51) Int. Cl.
*B08B 9/027* (2006.01)

(52) U.S. Cl.
USPC ..... 134/166 C; 134/175; 134/177; 134/178; 137/15.05; 62/129; 62/285

(58) Field of Classification Search
USPC ..... 134/166 R, 167 C, 169 C, 166 C, 134/175, 177, 178; 62/126, 129, 285; 137/15.05
See application file for complete search history.

(56) References Cited

U.S. PATENT DOCUMENTS

| | | | | |
|---|---|---|---|---|
| 3,494,113 | A | 2/1970 | Kinney | |
| 4,998,412 | A * | 3/1991 | Bell | 62/126 |
| 5,085,244 | A | 2/1992 | Funk | |
| 5,354,365 | A | 10/1994 | Youn | |
| 5,964,238 | A | 10/1999 | Junkin | |
| 6,182,677 | B1 * | 2/2001 | Pignataro | 137/15.05 |
| 6,442,956 | B1 | 9/2002 | Herren | |
| 6,584,995 | B2 | 7/2003 | Kimbrough et al. | |
| 6,708,717 | B1 * | 3/2004 | Coogle | 137/240 |
| 6,976,367 | B2 | 12/2005 | Spanger | |
| 7,191,606 | B1 | 3/2007 | Dwyer | |
| 7,392,658 | B1 | 7/2008 | Hardy, III | |
| 2003/0056812 | A1 * | 3/2003 | Baker et al. | 134/36 |
| 2011/0308557 | A1 | 12/2011 | Kaiser | |
| 2011/0308636 | A1 | 12/2011 | Kaiser | |
| 2012/0198804 | A1 | 8/2012 | Kaiser | |
| 2012/0248206 | A1 | 10/2012 | Kaiser | |
| 2012/0261921 | A1 | 10/2012 | Kaiser | |

* cited by examiner

*Primary Examiner* — Saeed T Chaudhry
(74) *Attorney, Agent, or Firm* — Venable LLP; Michele V. Frank

(57) ABSTRACT

The invention is directed toward a system and method for sanitizing a condensate drain to reduce sludge and related pathogens. The system is directed to a sanitizing assembly having a treatment chamber connected to the condensate drain, where the treatment chamber includes a top end and a shaft. A spray assembly is positioned proximate to the top end of the treatment chamber. This spray assembly has a nozzle spray connected to a hot water source. A spray controller within the spray assembly helps disperse a sufficient quantity and pressure of hot water within the shaft to dislodge sludge, when necessary.

15 Claims, 4 Drawing Sheets

SELF-SANITIZING AUTOMATED CONDENSATE DRAIN CLEANER AND RELATED METHOD OF USE

FIELD OF THE INVENTION

This invention is directed toward a system for self-cleaning condensate drains through an automated high temperature and pressure nozzle spray. More specifically, the invention relates to a plurality of thermocouples which line the condensate drain which, upon detecting a coating of sludge, activates a high temperature and pressure water supply to unclog the condensate drain.

BACKGROUND OF THE INVENTION

Apart from cooling air for circulation within a home or commercial facility, centralized air conditioners also produce condensate as a byproduct. Such condensate is created from the cooling of humid air, typically drawn from outside of the home or facility, upon treatment by the central air conditioner. Most modern central air conditioning systems include a condensate drain which collects this byproduct for removal outside of the home or facility. Such condensate drains often include a drain line which creates a conduit for removing condensate byproduct from the centralized air conditioner to a lawn, gutter or sewage treatment system.

One of the more common problems with centralized air conditioners is the frequent clogging of condensate drains. Typically, the clogging stems from the build-up of debris in the form of organic matter such as mold—which can include pathogens and bacteria. Such debris (aka "slime") typically builds over time, due to the warm and moist conditions within the condensate drain. This build up creates not only a health hazard but also may cause the air conditioning system to malfunction and fail. Accumulation of debris within condensate drains is known to cause colds, increase risk of asthma, cause fatigue, increased allergies, and even risk of Legionnaire's disease (Legionella bacteria).

Often, central air conditioning systems include a sensor in the event that a closed condensate drain risks back up of condensate byproduct. These sensors will effectively shut down and render the air conditioning system inoperable—until the line is unclogged and treated. This protocol ensures that the back-up would not ultimately cause a catastrophic failure of the air conditioning system.

Once the air conditioning system shuts down, current methods require that the condensate drain be manually cleaned. This can require the use of hoses, air pressure or snakes to be introduced to the condensate line to remove the obstruction or occlusion causing the back-up. Often, this will require the services of a service technician. The result is a temporary loss of air conditioning and a risk of mold growth within the home, as well as the costs associated with hiring the service technician.

Moreover, removing an obstruction within a condensate drain through manual effort fails to prevent future clogs. In many cases future clogs will return—as the same conditions typically exist for additional accumulation of debris (i.e., humidity, warm temperatures, low light). The result is routine manual maintenance of these condensate drains, which typically requires spending hundreds of dollars every year on hiring service technicians. This especially holds true in humid and warm climates like the Southeast United States.

The location and positioning of these condensate drains based upon modern construction standards only further complicates these issues. Many condominium and townhouses are now constructed to hide the condensate drains within the walls—and often the load bearing walls—of these dwellings. This makes it difficult if not impossible to replace these condensate drains. Accordingly, this makes routine maintenance of these systems even more important.

Currently, the main form of home treatment for condensate drains is use of strong chemicals like BenzylAmmonium Chloride. These strong chemicals are placed within tablets which are placed within the condensate pan, for absorption by the condensate byproduct—which in turn will treat debris throughout the condensate drain. One of the several drawbacks of employing these strong chemicals is two-fold. First, the chemicals create a large safety hazard. For example, BenzylAmmonium Chloride is a corrosive on the MSDS and can cause shortness of breath and a burning sensation in the throat. Long term exposure can cause coughing or wheezing.

A second limitation is that as a corrosive BenzylAmmonium Chloride can actually degrade and eat through the walls of the condensate drain after prolonged use. This in turn would limit the longevity of the condensate drain and require a full replacement (which may be difficult due to positioning within load bearing walls).

Accordingly, there is a need in the art of sanitizing condensate drains for a robust, safe and non-toxic form of cleaning. Moreover, such system should avoid the need for service technicians and be accomplished automatically. Finally, such a system should avoid using toxic chemicals or surfactants.

SUMMARY OF THE INVENTION

This invention solves many of the limitations found in current condensate drain designs. Moreover, the invention is directed toward both a system and related methods of using a sanitation assembly to help clean, dislodge and sanitize the condensate drain by reducing sludge and other pathogens. One system for sanitizing the condensate drain may include a treatment chamber (having a top end and a shaft) connected to the condensate drain. A spray assembly is positioned proximate to the top end of the treatment chamber, which may include a nozzle spray connected to a hot water source. Such spray assembly may also include one or more saddle valves. A main controller communicates with both the treatment chamber and spray assembly. Such main controller is capable of engaging (turning on) the spray assembly to disperse a sufficient quantity and pressure of hot water within the shaft to dislodge any sludge.

Optionally, the treatment chamber may include a set of thermocouples, which includes shaft temperature thermocouples and condensate temperature thermocouples. A measuring unit may record temperatures determined by both sets of thermocouples. A temperature controller, connected to the measuring unit, saddle valves and nozzle spray, helps engage the nozzle spray of the spray assembly when necessary. A first connector and second connector are used to secure and engage the sanitation assembly to the condensate drain.

Other components of the sanitation assembly may include a water flow valve, a float control, and a check valve. The float control may include a housing, a buoy positioned within the housing, a vertical rod and a measuring sensor. The check valve can include a pivoting swivel door mounted to a swivel hinge that can rotate and shut upon sensing a pressure change within the sanitation assembly.

The invention is also directed toward a method of sanitizing a condensate drain through use of a sanitation assembly. The method may begin with measuring the condensate temperature within a treatment chamber connected to the condensate drain. Second, the temperature of the shaft is assessed. Third, the method contemplates reporting the temperature measurements to a measuring unit proximate to the treatment chamber. The measuring unit calculates the difference between the condensate temperature and the shaft temperature. After this calculation and determining whether the temperature difference is within a specified threshold, the method contemplates reporting an alert to the temperature controller if such temperature difference is above the threshold to engage the sanitizing assembly for a period of time.

BRIEF DESCRIPTION OF THE. DRAWINGS

For a fuller understanding of the invention, reference is made to the following detailed description, taken in connection with the accompanying drawings illustrating various embodiments of the present invention, in which.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Overall Positioning and Location of System

Figure 1:
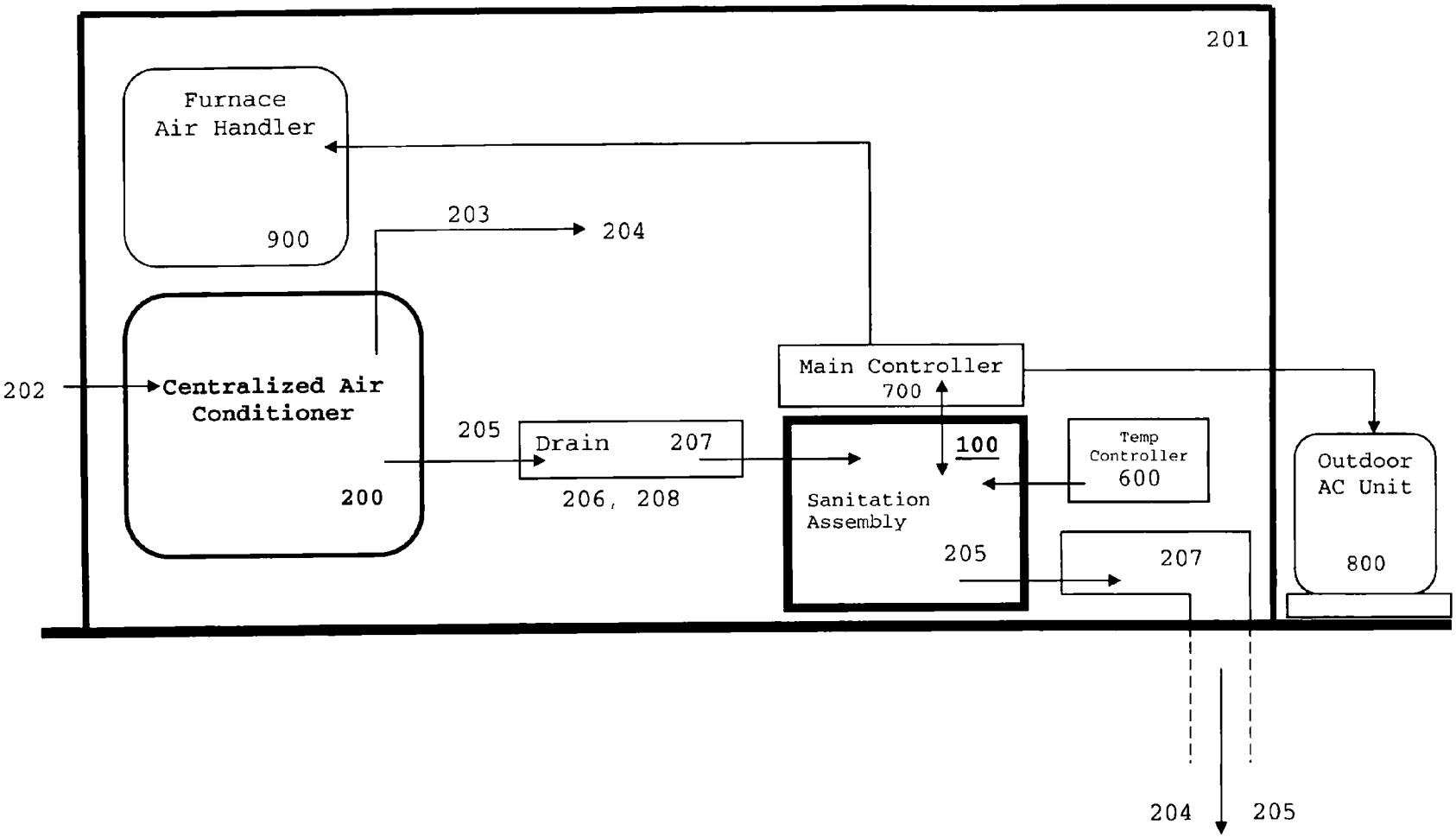
FIG. 1 is a schematic that illustrates the placement of the sanitation assembly in light of a central air conditioner.

FIG. 1 illustrates, by way of example, one preferred positioning and location of a sanitation assembly 100. As shown, most residential and/or commercial facilities 201 (especially those located in sub-tropical and/or warm climates) include a centralized air conditioner system 200 (hererinafter an "air conditioner"). The air conditioner 200 takes in warm moist air 202 from outside of the facility 201 and then cools that warm moist air 202. This process results in two primary byproducts 203: the first is cooled air 204, while the second is liquid condensate 205.

The condensate 205 created by the air conditioner 200 is the result of reducing the temperature of the warm most air 202, which in turn draws and accumulates the resulting water by product 203 within the system. It is important to note that condensate 205, as a byproduct 203, not only includes water but also any related matter previously dispersed within the warm moist air 202. This can include pathogens 206, but is certainly not limited to, bacteria, viruses, dust, and related particulates.

With traditional systems, the condensate 205 would be removed from the air conditioner 200 through a condensate drain 207. A condensate drain 207 is essentially a conduit and reservoir which directs condensate 205 away from the air conditioner 200 and typically drains this byproduct 203 outside of the facility 201, such as in the exterior ground or into the municipal sewage system. As previously discussed, the conditions within the condensate drain 207 (dark, humid, and warm) make it highly susceptible to the growth of pathogens 206, which can cause build-up in the form of sludge 208.

As shown and illustrated in FIG. 1, the invention contemplates positioning a sanitation assembly 100 within the condensate drain 207. There are four primary functions for the sanitation assembly 100. First, the sanitation assembly 100, as taught by the invention, detects whether there is a sufficient level of sludge 208 within the condensate drain 207—which may cause a potential health risk. Second, once detected, the sanitation assembly 100 helps break-up and remove the sludge 208 through a high pressure and temperature water spray. Third, as a result of removal of sludge 208, the sanitation assembly 100 helps reduce the overall volume of pathogens 206 within the air conditioner 200 and helps create a more sanitized and clean environment. Fourth, the sanitation assembly prevents the back-up of condensate 205 within the air conditioner 200 which may risk shutting down the system and resulting in receipt of cooler air 204 within the facility 201.

Accordingly, the sanitation assembly 100 functions to remove both condensate 205 and sludge 208 away from not only the air conditioner 200 but to also remove these byproducts 204 away from the facility 201 as well.

Components of the Sanitation Assembly

Figure 2:
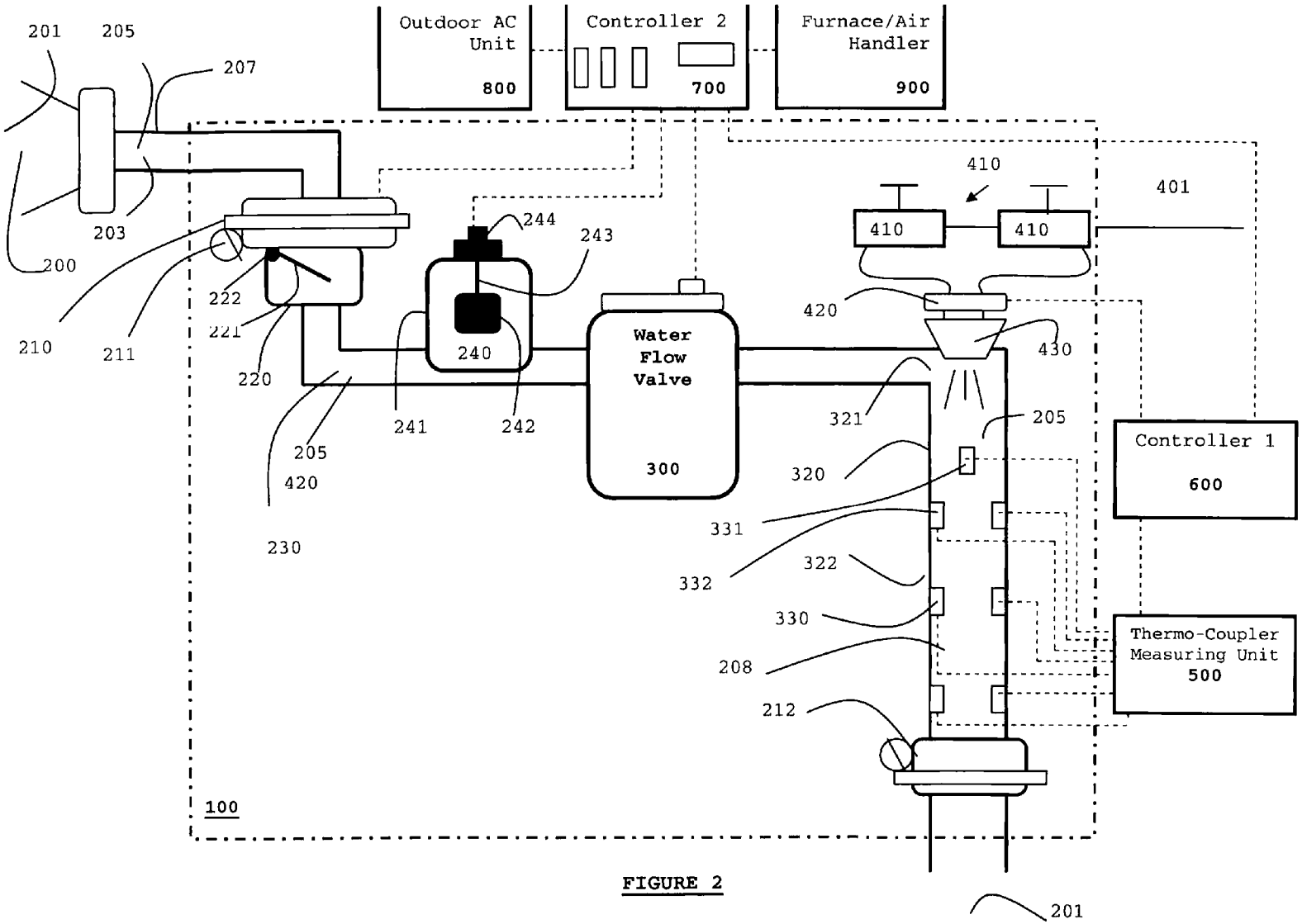
FIG. 2 illustrates the various components of a sanitation assembly, including both controllers.

While FIG. 1 identifies one possible placement of the sanitation assembly 100 within a condensate drain 207, FIG. 2 offers, by way of example, one embodiment of the underlying components. As shown in FIG. 2, the sanitation assembly 100 attaches to the condensate drain 207 through a plurality of connectors 210. Preferably, the sanitation assembly 100 can connect through a first connector 211 and a corresponding second connector 212. The first connector 211 affixes at a point proximate to the air conditioner 200 (shown in FIG. 1).

Correspondingly, the second connector 212 attaches to that portion of the condensate drain 207 which directs condensate 205 outside and away from the facility 201. As shown in FIG. 2, the positioning and placement of both connectors 210 help balance and secure the sanitation assembly 100. While the connectors 210 can be any known system of affixing known to those of ordinary skill, they are preferably hose clamps.

Positioned below the first connector 211 is a low tension check valve 220. Preferably made of PVC, the check valve 220 preferably includes a pivoting swivel door 221 mounted to a swivel hinge 222 that can rotate and shut upon sensing a pressure change within the sanitation assembly 100. This pivoting swivel door 221 offers an important safety feature of the sanitation assembly 100. More specifically, the check valve 220 insures that upon any form of occlusion within the sanitation assembly 100, the system can seal the condensate drain 207. Examples of occlusions could include sludge 208 or some bio-material emanating from outside of the facility 201. This in turn protects the internal components of the air conditioner 200.

As further shown in FIG. 2, positioned directly below the check valve 220 is an "L" shaped feeder conduit 230. The feeder conduit 230 repositions the condensate 205 from a vertical position to a horizontal position. Put another way, so long as there is no back pressure, condensate 205 flows through the check valve 220 vertically and then is transitioned to a horizontal position.

At the end of the feeder conduit 230 is a float control 240. The float control 240 measures the pressure of the condensate 207 within the sanitation assembly 100. As shown in FIG. 2, the float control 240 includes four primary components: a housing 241, a buoy 242 positioned within the housing 241, a vertical rod 243 and a measuring sensor 244 located on top of the housing 241. As internal pressure builds, the buoy 242 rises within the housing 241, causing the vertical rod 242 to interact with the measuring sensor 243. In turn, the measuring sensor 244 can communicate with the main controller 700 (discussed in greater detail below) to address the pressure build-up.

Positioned further downstream from the float control 240 is the water flow valve 300. While the float control 240 measures the pressure of the condensate 205, the water flow valve 300 measures both the flow rate of the condensate and also regulates the flow rate to ensure proper disbursement. In addition, water flow valve 300 reports this information to the main controller 700 (again discussed in greater detail below). By assessing the water flow valve 300, the sanitation assembly 100 can assess if there is a build-up of sludge 208 (i.e., a gradual slow down of the flow rates).

The Vertical Treatment Chamber

As also shown in FIG. 2, attached to the water flow valve 300 is a vertical treatment chamber 320. This treatment chamber 320 includes a top end 321 and an elongated shaft 322. As shown in FIG. 2, a pressure spray assembly 400 is positioned at the top end 321 of the treatment chamber 320. The spray assembly 400 includes one or more saddle valves 410, a back flow preventer 420, and a nozzle spray 430. Each saddle valve 410 connects to a hot water 401 supply (typically between 110 to 135 degrees Fahrenheit) such as a residential tankless (flash) water heater. Each saddle valve 410 feeds into the back flow preventer 420, which ensures that condensate 205 does not flow into the residential hot water 401 supply (i.e., one directional flow into the treatment chamber 320).

The hot water 401 then flows from the back flow preventer 420 to the nozzle spray 430. The nozzle spray 430 functions to inject a concentrated quantity of hot water 401 into the treatment chamber 320 to dislodge and unclog any sludge 208 within the condensate drain 207. Moreover, the nozzle spray 430 connects to the spray controller 600 (discussed in detail below)—which determines when to open each saddle valve 410 and release the hot water 401 from the nozzle spray 430.

Positioned within the shaft 322 of the treatment chamber 320 are a plurality of thermocouples 330. There are essentially two sets of thermocouples 330 positioned within the treatment chamber 320: wall temperature thermocouples 331 and condensate temperature thermocouples 332.

Both sets of thermocouples 330 are connected to a measuring unit 500—which measures the temperature differential between the wall temperature and the condensate temperature. Should the wall temperature thermocouples 331 measure a temperature different than the condensate temperature thermocouples 332, this would suggest that the shaft 322 is being insulated by debris—which likely means sludge 208 build up. Upon detecting this temperature differential, the measuring unit 500 compares this differential to a pre-specified threshold value and communicates the spray controller 600 to release the hot water 401 from the nozzle spray 430 (as described in FIGS. 3 and 4 discussed in greater detail below).

The Main and Spray Controllers

In addition to the sanitizing assembly 100, the invention is also directed to a main controller 700 for ensuring the integrity of the air conditioner 200 and to prevent build up of sludge 208. The main controller 700 is connected to three primary measuring devices of the sanitizing assembly 100: the check valve 220; the float control 230 and the water flow valve 330. Measuring these three devices helps the main controller 700 determine if there is a risk for back up of condensate 205 into the air conditioner 200 or slowly decreased flow rate.

In addition, the main controller 700 communicates with the spray controller 600. This allows the main controller 700 to perform scheduled and timed sprays of hot water 401 into the treatment chamber 320. In addition, the main controller 700 can record and denote the number of times the measuring unit 500 denotes a sufficient temperature difference to warrant an additional spray.

This main controller 700 also communicates with outdoor air unit 800 and air handler 900—to help increase efficiencies and record measurements.

Method of Use

Figure 3:
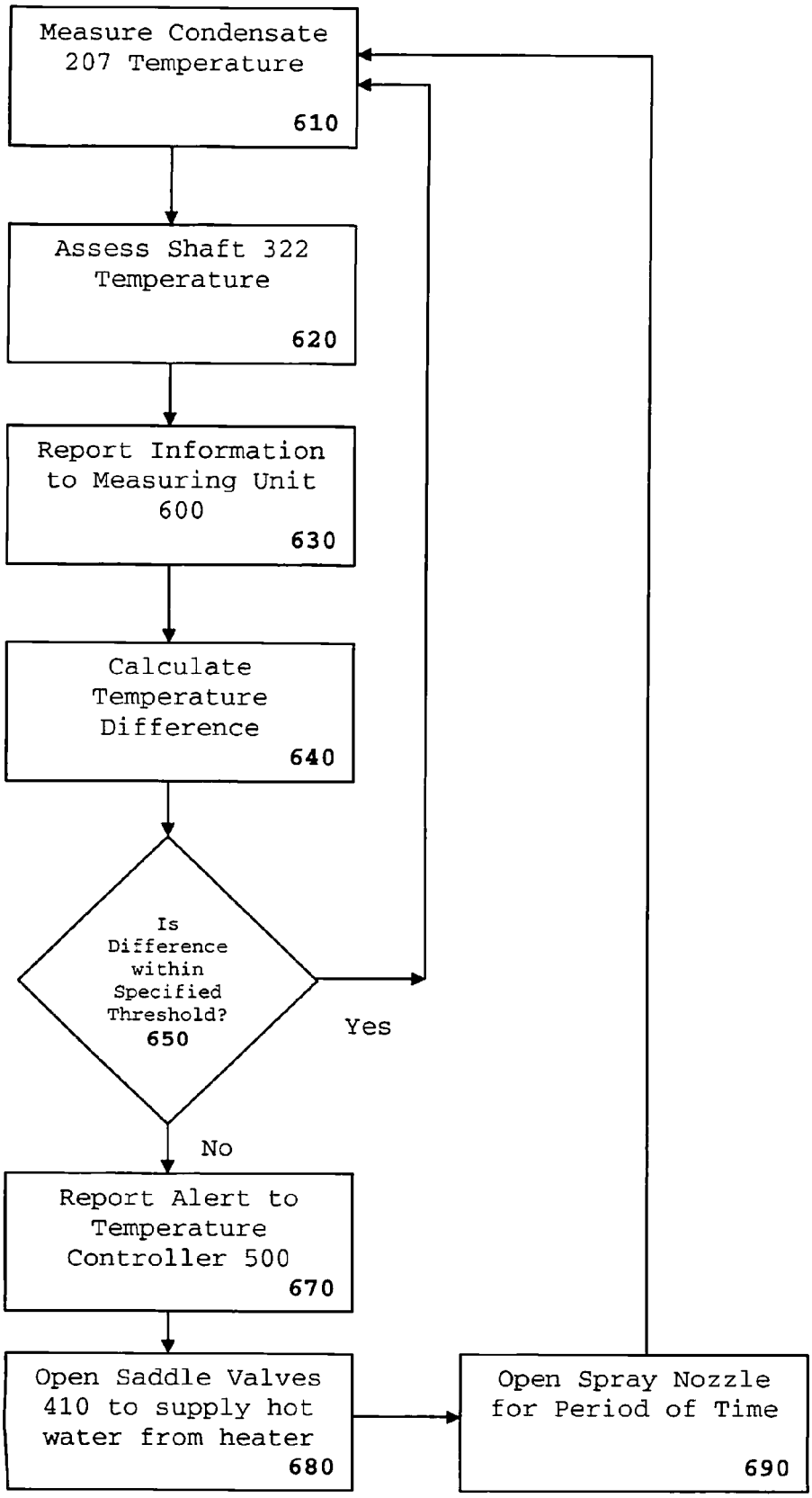
FIG. 3 is a schematic showing one method of sanitizing the condensate drain through measuring temperature differentials.
Figure 4:
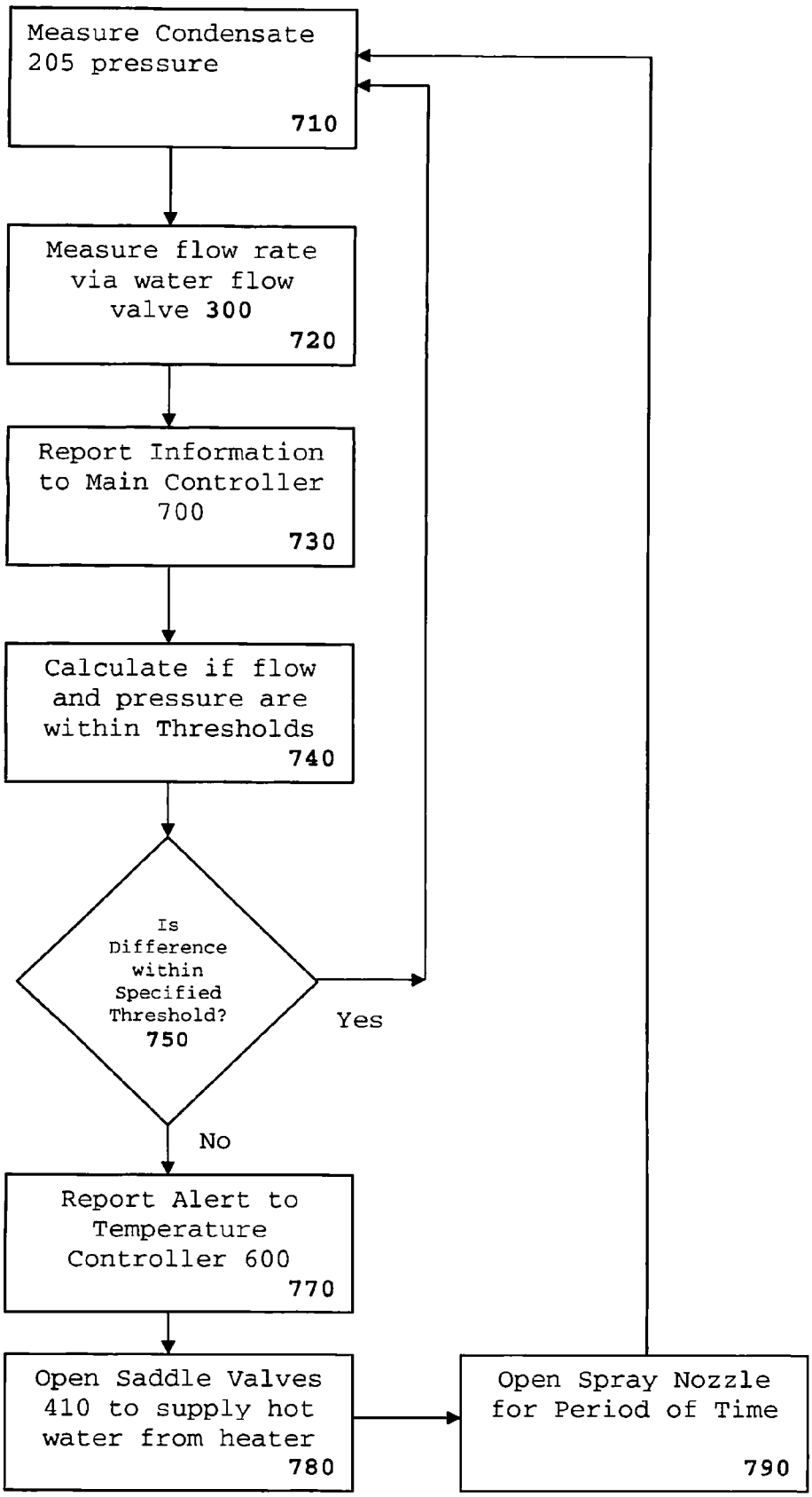
FIG. 4 is a schematic showing a second method of sanitizing the condensate drain by measuring pressure and flow rate changes within the sanitizing assembly.

In addition to the underlying system, the invention is further directed to a method of sanitizing a condensate drain 207. Both FIG. 3 and FIG. 4 illustrate, by way of example, protocols for ensuring the condensate drain 207 remains clog-free from build-up of sludge 208 and pathogens 206. These protocols can be performed through various timed sequences (carried out at intervals throughout the calendar year), or can be automated based upon measurements suggesting a potential risk of clog or build-up of sludge 208.

FIG. 3 offers one way of automatic measurement and treatment to prevent sludge 208 from building up within the interior walls of the shaft 322 located within the treatment chamber 320. This method is achieved through communication with a plurality of thermocouples 330 (shown in FIG. 2). More specifically, the protocol calls for reading both wall temperature thermocouples 331 and condensate temperature thermocouples 332.

As further shown in FIG. 3, the method first begins with measuring (at 610) the temperature of the condensate 205 within the shaft 322 of the condensate drain through use of the condensate temperature thermocouples 332. Next, the measuring unit 600 determines (at 620), through use of the wall temperature thermocouple 331, the temperature of the shaft 322. Both sets of information are then collected and reported (at 630) to the measuring unit 500. Fourth, the measuring unit 500 calculates (at 640) the temperature difference between both thermocouples 331 and 332.

Upon measuring the temperature difference between the shaft 332 and the condensate 205—to determine if the shaft 322 has become inundated with sludge 208—the measuring unit 500 then assesses (at 650) if the temperature difference is above a specified threshold. If the difference is negligible, the method returns to step 610 and repeats as necessary.

However, if the measuring unit 500 deems there is a sufficient temperature difference, this information is reported (at 670) to the spray controller 600. Accordingly, the spray controller 600 can open (at 680) the saddle valves 410 to receive hot water 401 from the water heater (or any other similar hot water 401 source). In turn, the spray controller 600 can order the nozzle spray 430 to open for a specified period of time. Based upon this, the pressurized water helps remove particulates, including sludge 208, pathogens 206 and other byproducts 203 from within the condensate drain 207.

FIG. 4 illustrates one protocol where the flow rate and pressure of condensate 205 are used to determine if it is necessary to engage the nozzle spray 430. As shown, the method employs use of the main controller 700, as well as the water flow valve 300 and the low tension check valve 220. To begin, the main controller 700 measures (at 710) the pressure of the water measured by the low tension check valve 220. Second, the main controller 700 assesses (at 720) the flow rate of the condensate 205 through use of the water flow valve 300. Information is then reported (at 730) to the main controller 700 for analysis. Next, the main controller 700 calculates (at 740) whether there is any suggestion of sludge 208 build up. This assessment is based upon slow decreases in flow rates or gradual increases in pressure (based upon historic data recorded by the main controller 700).

Based upon these measurements, the main controller 700 assesses if there is a difference within the specified thresholds for pressure and flow rate. If there are sufficient differences (i.e., not within the thresholds), this information is reported (at 770) to the spray controller 600. Otherwise, then the method returns to the initial measuring step at 710.

However, should threshold be crossed and information alerted to the spray controller 600, the method next contemplates opening (at 680) the saddle valves 410 to receive hot water 401 from the water heater. In turn, the temperature controller 600 can order the nozzle spray 430 to open for a specified period of time. Based upon this, the pressurized water helps remove particulates, including sludge 208, pathogens 206 and other byproducts 203, from within the condensate drain 207.

Apart from using various sensors, the main controller 700 can have timing sequences when it orders the spray controller 600 to initiate a spraying (opening the saddle valves 410 and the nozzle spray 430).

The invention claimed is:

1. A sanitation assembly for a condensate drain of an air handler, wherein the condensate drain drains condensate away from the air handler, the sanitation assembly comprising:

an inlet for connecting to the condensate drain of the air handler;

a treatment chamber connected to the inlet, wherein condensate drains into the treatment chamber from the air handler through the inlet, the treatment chamber having a top end and a shaft;

a spray assembly positioned proximate to the top end of the treatment chamber, the spray assembly having a nozzle spray positioned to spray fluid in the shaft of the treatment chamber; and a controller, wherein the controller controls the spray assembly, the controller configured to detect debris in the shaft;

wherein when the controller detects debris in the shaft, the controller engages the spray assembly to spray fluid in the shaft of the treatment chamber in order to increase pressure against the detected debris.

2. The sanitation assembly of claim 1, wherein the spray assembly also includes one or more saddle valves connected to the nozzle spray.

3. The sanitation assembly of claim 1, further comprising a set of thermocouples which measure temperature of the shaft as well as the condensate;

a measuring unit capable of measuring a temperature differential between the condensate and shaft; and a temperature controller connected to measuring unit.

4. The sanitation assembly of claim 1, further comprising: a first connector and a second connector to secure the sanitation assembly to the condensate drain.

5. The sanitation assembly of claim 1, further comprising a water flow valve.

6. The sanitation assembly of claim 1, further comprising a float control having a housing, a buoy positioned within the housing, a vertical rod and a measuring sensor.

7. The sanitation assembly of claim 1, further comprising a low tension check valve having a pivoting swivel door mounted to a swivel hinge that can rotate shut upon sensing a pressure change within the sanitation assembly.

8. The sanitation assembly of claim 1, wherein the fluid is hot water.

9. The sanitation assembly of claim 1, wherein the shaft is a hollow shaft.

10. A system for sanitizing a condensate drain to reduce sludge, the system comprising:

a treatment chamber connected to the condensate drain, the treatment chamber having a top end and a shaft;

a spray assembly positioned proximate to the top end of the treatment chamber, the spray assembly having a nozzle spray connected to a hot water source;

a spray controller capable of engaging the spray assembly to disperse a sufficient quantity and pressure of hot water within the shaft to dislodge sludge;

a set of thermocouples which measure temperature of the shaft as well as the condensate;

a measuring unit capable of measuring a temperature differential between the condensate and shaft; and a temperature controller connected to measuring unit.

11. The system of claim 8, wherein the spray assembly also includes one or more saddle valves, which are connected to the nozzle spray.

12. The system of claim 8, further comprising: a first connector and a second connector sufficient to secure the sanitation assembly to the condensate drain.

13. The system of claim 8, further comprising a water flow valve.

14. The system of claim 8, further comprising a float control having a housing, a buoy positioned within the housing, a vertical rod and a measuring sensor.

15. The system of claim 8, further comprising a low tension check valve having a pivoting swivel door mounted to a swivel hinge that can rotate shut upon sensing a pressure change within the sanitation assembly.

* * * * *